US012516602B2

(12) United States Patent
Wang et al.

(10) Patent No.: US 12,516,602 B2
(45) Date of Patent: Jan. 6, 2026

(54) HIGH-RELIABILITY DATA COMPRESSION AND TELEMETRY SCHEME FOR REAL-TIME LOGGING DATA TRANSMISSION

(71) Applicant: Halliburton Energy Services, Inc., Houston, TX (US)

(72) Inventors: Yadong Wang, Singapore (SG); Xiang Wu, Singapore (SG); Matthew Hui Chong, Houston, TX (US); Felipe Costa Oliveira Chagas, Houston, TX (US); Bipin K. Pillai, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 59 days.

(21) Appl. No.: 18/403,212

(22) Filed: Jan. 3, 2024

(65) Prior Publication Data

US 2025/0215789 A1 Jul. 3, 2025

(51) Int. Cl.

| | |
|---|---|
| ***E21B 47/13*** | (2012.01) |
| ***E21B 44/00*** | (2006.01) |
| ***E21B 47/18*** | (2012.01) |
| *E21B 47/06* | (2012.01) |

(52) U.S. Cl.

CPC ..... *E21B 47/13* (2020.05); *E21B 44/00* (2013.01); *E21B 47/18* (2013.01); *E21B 47/06* (2013.01)

(58) Field of Classification Search

CPC ..... E21B 47/13; E21B 44/00; E21B 47/18; E21B 47/06

See application file for complete search history.

(56) References Cited

U.S. PATENT DOCUMENTS

| | | | | |
|---|---|---|---|---|
| 2005/0012637 | A1* | 1/2005 | Golla | E21B 47/18 340/853.3 |
| 2013/0135114 | A1 | 5/2013 | Ringer et al. | |
| 2017/0089195 | A1 | 3/2017 | Yu | |
| 2020/0102817 | A1* | 4/2020 | Couturier | E21B 47/003 |

(Continued)

OTHER PUBLICATIONS

International Search Report & Written Opinion; PCT Application No. PCT/US2024/010296; mailed Sep. 24, 2024.

*Primary Examiner* — Amine Benlagsir

(74) *Attorney, Agent, or Firm* — NOVAK DRUCE CARROLL LLP

(57) ABSTRACT

Described herein are systems and techniques for improving the transmission of data up a wellbore such that wellbore operations may be performed or controlled more efficiently. When a wellbore is drilled or otherwise used, sensors may be deployed in the wellbore to measure parameters that may include borehole pressure, annular pressure, weight-on-bit, torque-on-bit, temperature, or other borehole logging data, for example. Data sensed by the sensors or interpreted from received sensor data may be sent up-hole to electronics that may reside at the surface of the Earth. Since wellbore (borehole) logging data usually have moderate levels of continuity or consistency between respective samples, differences between data samples acquired over a period of time may be expected to have smaller amplitudes/deviations than the data samples themselves. As such, data compression can be achieved by transmitting data that identifies a difference between an initial data sample and a subsequent reference data sample.

21 Claims, 6 Drawing Sheets

(56) References Cited

U.S. PATENT DOCUMENTS

| | | | | |
|---|---|---|---|---|
| 2020/0241166 | A1* | 7/2020 | Marsh | E21B 47/20 |
| 2020/0325767 | A1 | 10/2020 | Miller et al. | |
| 2023/0102885 | A1* | 3/2023 | Wiecek | E21B 47/022 175/45 |
| 2023/0137394 | A1 | 5/2023 | Chong et al. | |
| 2024/0133287 | A1* | 4/2024 | Johnson | E21B 44/06 |

* cited by examiner

HIGH-RELIABILITY DATA COMPRESSION AND TELEMETRY SCHEME FOR REAL-TIME LOGGING DATA TRANSMISSION

TECHNICAL FIELD

The present disclosure is generally directed to more reliability transmitting data. More specifically, the present disclosure relates to methods and apparatus that efficiently transmit data.

BACKGROUND

When operations associated with developing and using wells drilled into strata of the Earth are performed, data may be transmitted from tools deployed in a wellbore to devices that may be located at the surface of the Earth. This may include transmitting data through fluids that may include or be comprised of drilling mud. Drilling mud is commonly pumped down into a wellbore when a drill bit of a drilling apparatus drills the wellbore. At this time, a flow of the drilling mud moves to the drill bit where the drilling mud lubricates the drill bit. As the drill bit cuts into subterranean formations, waste materials cut from subterranean formations are moved back up the wellbore to the Earth's surface with the flow drilling mud such that the waste materials may be disposed of. Tools deployed with the drilling apparatus may include sensors that sense drill bit orientation, wellbore temperatures, wellbore pressures, formation characteristics, and/or possibly other metrics that may be critical to proper development or operation of the wellbore. Data from these sensors or data generated based on interpretations of sensed data may be transmitted up the wellbore via a fluid medium that may include the aforementioned drilling mud. Since transmitting data through fluid mediums is often an inefficient operation and since transmission efficiencies reduce as transmission frequency is increased, rates at which such data can be transmitted up the wellbore is often limited or error prone. This means that data rates used to transmit this data up the wellbore are limited and error rates can be expected to increase when transmission frequencies are increased. Furthermore, to adequately control wellbore operations and to meet bandwidth constraints or budgetary constraints, a sufficient amount of data can be transmitted up-hole as the wellbore is being developed. For these reasons, wellbore operations may suffer either by having to proceed more slowly than required to meet a constraint or by not having enough data available such that a system controls a wellbore operation can proceed according to a development plan.

BRIEF DESCRIPTION OF THE DRAWINGS

In order to describe the manner in which the features and advantages of this disclosure can be obtained, a more particular description is provided with reference to specific implementations thereof which are illustrated in the appended drawings. Understanding that these drawings depict only exemplary implementations of the disclosure and are not therefore to be considered to be limiting of its scope, the principles herein are described and explained with additional specificity and detail through the use of the accompanying drawings in which.

DETAILED DESCRIPTION

Figure 1A:
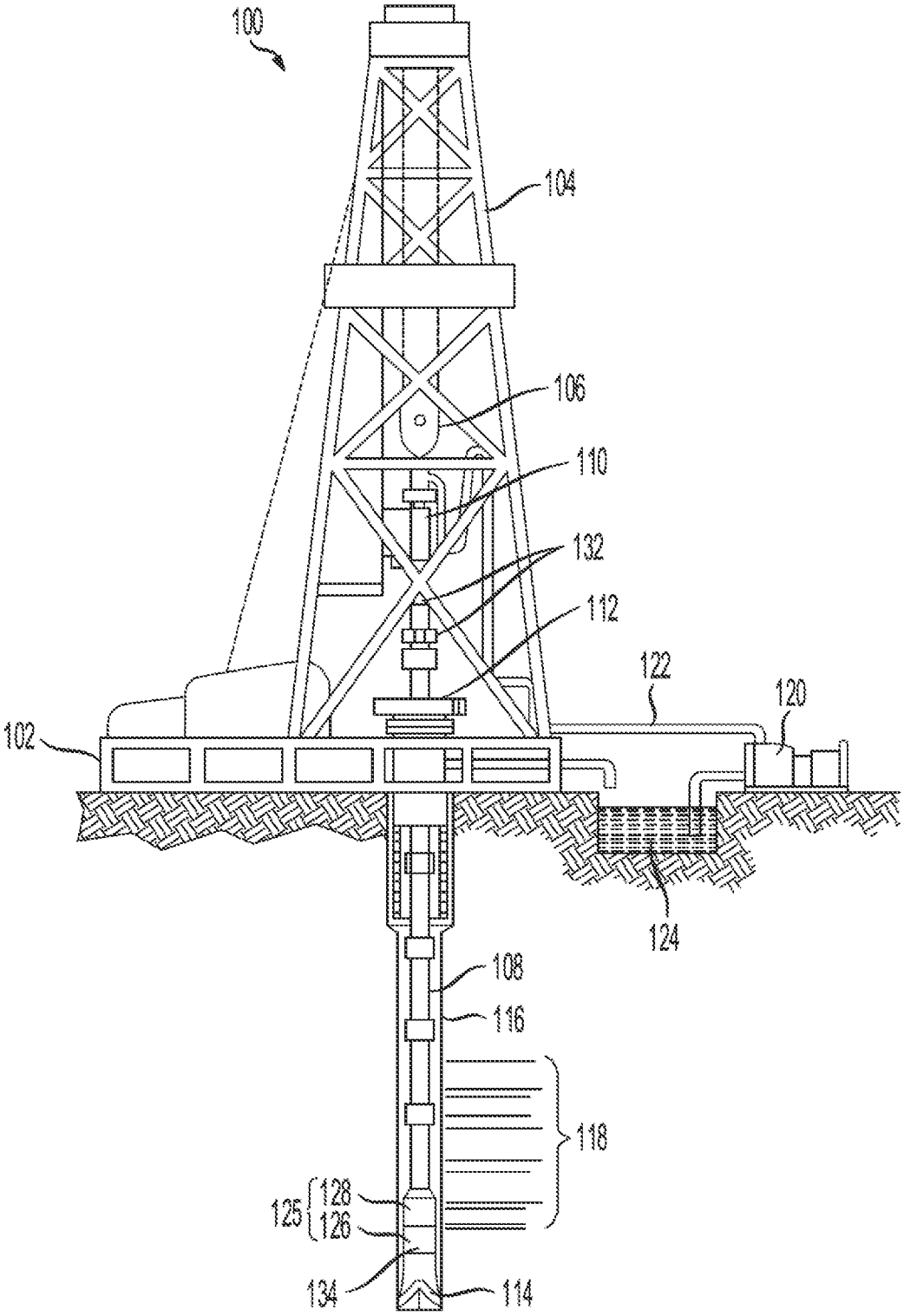
FIG. 1A is a schematic diagram of an example logging while drilling wellbore operating environment, in accordance with various aspects of the subject technology.

Various aspects of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the principles disclosed herein. The features and advantages of the disclosure can be realized and obtained by means of the instruments and combinations particularly pointed out in the appended claims. These and other features of the disclosure will become more fully apparent from the following description and appended claims or can be learned by the practice of the principles set forth herein.

It will be appreciated that for simplicity and clarity of illustration, where appropriate, reference numerals have been repeated among the different figures to indicate corresponding or analogous compounds. In addition, numerous specific details are set forth in order to provide a thorough understanding of the methods and apparatus described herein. However, it will be understood by those of ordinary skill in the art that the methods and apparatus described herein can be practiced without these specific details. In other instances, methods, procedures, and components have not been described in detail so as not to obscure the related relevant feature being described. The drawings are not necessarily to scale, and the proportions of certain parts may be exaggerated to better illustrate details and features. The description is not to be considered as limiting the scope of the present disclosure.

Described herein are systems, apparatuses, processes (also referred to as methods), and computer-readable media (collectively referred to as "systems and techniques") for improving the transmission of data up a wellbore such that wellbore operations may be performed or controlled more efficiently. When a wellbore is drilled or otherwise used, sensors may be deployed in the wellbore to measure parameters that may include borehole pressure, annular pressure, weight-on-bit, torque-on-bit, temperature, or other borehole logging data, for example. Data sensed by the sensors or interpreted from received sensor data may be sent up-hole to electronics that may reside at the surface of the Earth. Since wellbore (borehole) logging data usually have moderate levels of continuity or consistency between respective samples, differences between data samples acquired over a period of time may be expected to have smaller amplitudes/ deviations than the data samples themselves. As such, data compression can be achieved by transmitting data that identifies a difference between an initial data sample and a subsequent reference data sample.

FIG. 1A is a schematic diagram of an example logging while drilling wellbore operating environment. The drilling arrangement shown in FIG. 1A provides an example of a logging-while-drilling (commonly abbreviated as LWD) configuration in a wellbore drilling scenario 100. The LWD configuration can incorporate sensors (e.g., EM sensors, seismic sensors, gravity sensor, image sensors, etc.) that can acquire formation data, such as characteristics of the formation, components of the formation, etc. For example, the drilling arrangement shown in FIG. 1A can be used to gather formation data through an electromagnetic imager tool (not shown) as part of logging the wellbore using the electromagnetic imager tool. The drilling arrangement of FIG. 1A also exemplifies what is referred to as Measurement While Drilling (commonly abbreviated as MWD) which utilizes sensors to acquire data from which the wellbore's path and position in three-dimensional space can be determined. FIG. 1A shows a drilling platform 102 equipped with a derrick 104 that supports a hoist 106 for raising and lowering a drill string 108. The hoist 106 suspends a top drive 110 suitable for rotating and lowering the drill string 108 through a well head 112. A drill bit 114 can be connected to the lower end of the drill string 108. As the drill bit 114 rotates, it creates a wellbore 116 that passes through various subterranean formations 118. A pump 120 circulates drilling fluid through a supply pipe 122 to top drive 110, down through the interior of drill string 108 and out orifices in drill bit 114 into the wellbore. The drilling fluid returns to the surface via the annulus around drill string 108, and into a retention pit 124. The drilling fluid transports cuttings from the wellbore 116 into the retention pit 124 and the drilling fluid's presence in the annulus aids in maintaining the integrity of the wellbore 116. Various materials can be used for drilling fluid, including oil-based fluids and water-based fluids.

Logging tools 126 can be integrated into the bottom-hole assembly 125 near the drill bit 114. As drill bit 114 extends into the wellbore 116 through the formations 118 and as the drill string 108 is pulled out of the wellbore 116, logging tools 126 collect measurements relating to various formation properties as well as the orientation of the tool and various other drilling conditions. The logging tool 126 can be applicable tools for collecting measurements in a drilling scenario, such as the electromagnetic imager tools described herein. Each of the logging tools 126 may include one or more tool components spaced apart from each other and communicatively coupled by one or more wires and/or other communication arrangement. The logging tools 126 may also include one or more computing devices communicatively coupled with one or more of the tool components. The one or more computing devices may be configured to control or monitor a performance of the tool, process logging data, and/or carry out one or more aspects of the methods and processes of the present disclosure.

The bottom-hole assembly 125 may also include a telemetry sub 128 to transfer measurement data to a surface receiver 132 and to receive commands from the surface. In at least some cases, the telemetry sub 128 communicates with a surface receiver 132 by wireless signal transmission (e.g., using mud pulse telemetry, EM telemetry, or acoustic telemetry). In other cases, one or more of the logging tools 126 may communicate with a surface receiver 132 by a wire, such as wired drill pipe. In some instances, the telemetry sub 128 does not communicate with the surface, but rather stores logging data for later retrieval at the surface when the logging assembly is recovered. In at least some cases, one or more of the logging tools 126 may receive electrical power from a wire that extends to the surface, including wires extending through a wired drill pipe. In other cases, power is provided from one or more batteries or via power generated downhole.

Collar 134 is a frequent component of a drill string 108 and generally resembles a very thick-walled cylindrical pipe, typically with threaded ends and a hollow core for the conveyance of drilling fluid. Multiple collars 134 can be included in the drill string 108 and are constructed and intended to be heavy to apply weight on the drill bit 114 to assist the drilling process. Because of the thickness of the collar's wall, pocket-type cutouts or other type recesses can be provided into the collar's wall without negatively impacting the integrity (strength, rigidity and the like) of the collar as a component of the drill string 108.

Figure 1B:
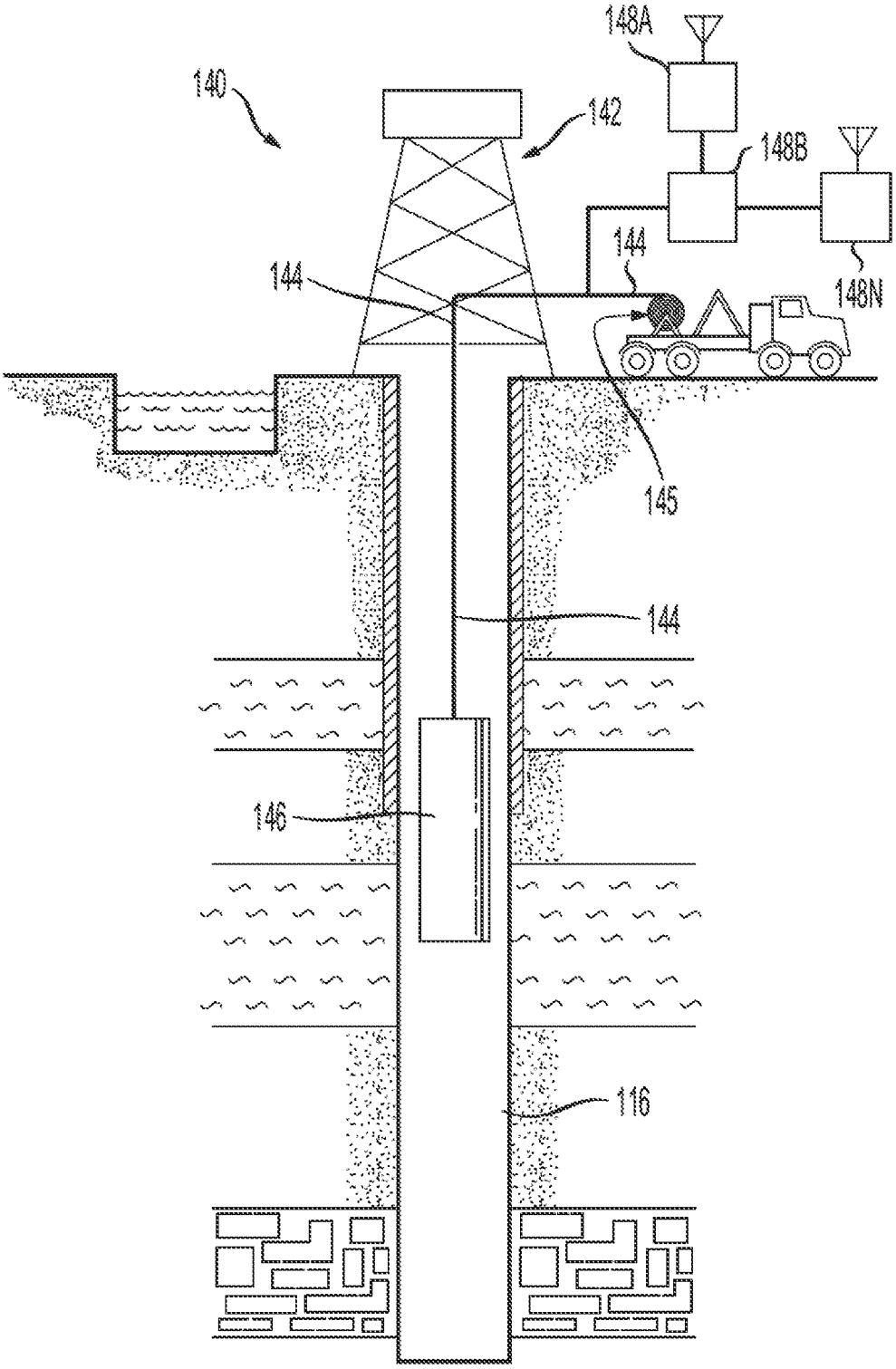
FIG. 1B is a schematic diagram of an example downhole environment having tubulars, in accordance with various aspects of the subject technology.

FIG. 1B is a schematic diagram of an example downhole environment having tubulars. Here, an example system 140 is depicted for conducting downhole measurements after at least a portion of a wellbore has been drilled and the drill string removed from the well. An electromagnetic imager tool (not shown) can be operated in example system 140 shown in FIG. 1B to log the wellbore. A downhole tool is shown having a tool body 146 in order to carry out logging and/or other operations. For example, instead of using the drill string 108 of FIG. 1A to lower the downhole tool, which can contain sensors and/or other instrumentation for detecting and logging nearby characteristics and conditions of the wellbore 116 and surrounding formations, a wireline conveyance 144 can be used. The tool body 146 can be lowered into the wellbore 116 by wireline conveyance 144. The wireline conveyance 144 can be anchored in the drill rig 142 or by a portable means such as a truck 145. The wireline conveyance 144 can include one or more wires, slicklines, cables, and/or the like, as well as tubular conveyances such as coiled tubing, joint tubing, or other tubulars. The downhole tool can include an applicable tool for collecting measurements in a drilling scenario, such as the electromagnetic imager tools described herein.

The illustrated wireline conveyance 144 provides power and support for the tool, as well as enabling communication between data processors 148A-N on the surface. In some examples, the wireline conveyance 144 can include electrical and/or fiber optic cabling for carrying out communications. The wireline conveyance 144 is sufficiently strong and flexible to tether the tool body 146 through the wellbore 116, while also permitting communication through the wireline conveyance 144 to one or more of the processors 148A-N, which can include local and/or remote processors. The processors 148A-N can be integrated as part of an applicable computing system, such as the computing device architectures described herein. Moreover, power can be supplied via the wireline conveyance 144 to meet power requirements of the tool. For slickline or coiled tubing configurations, power can be supplied downhole with a battery or via a downhole generator.

In a logging-while-drilling (LWD) process, different types of time-sensitive data (e.g., borehole pressure, annular pressure, weight-on-bit, torque-on-bit, temperature, or other data) may have to be transmitted from the downhole to the surface in real-time without delay. Due to constraints of the wellbore environment, data transmission rates used during by an LWD telemetry system, are limited. As such, some form of data compression may be critical to being able to timely send data from downhole to the surface such that a wellbore operation may be adequately controlled. Because of this, time-sensitive data may be compressed by sending the difference between current sample of sensed data followed by sending one or more reference samples over time. This may include sending a measured value of pressure, for example, followed by sending changes to that measured value of pressure in each respective reference sample. The measured value of pressure initially sent to the surface may include a number of bits used to represent the measured pressure value. This may mean that the first pressure value is sent using 16 bits of binary data. Each reference sample may use a fewer number of bits than the 16 bits used to send the full measured pressure value. For example, the reference sample may only send 4 bits of data and each respective reference sample may identify a change in pressure since the last full measured pressure value or since the last reference sample.

After some number of reference samples are sent to the surface, a second full measurement value (e.g., of pressure) may be sent to the surface. This, second full measurement value may, once again, be sent using 16 bits of binary data. In certain instances, this second full measurement value may also be accompanied by a difference value that identifies a change in the measurement value since the last full measurement value was sent. This may be done just in case the last full measurement value sent to the surface was not received at the surface or may be done such that a computer organizing or evaluating LWD data may check to see whether data sent since the last full measurement value was sent is consistent with the second full measurement value and with the difference data sent with the second full measurement value.

Table 1 illustrates an instance when a measured pressure value is sent from an LWD tool to a computer at the surface followed by sending nine reference samples. Table 1 includes three columns of data that identify a sample number (#), an annular pressure that can be represented in 16 bits, and pressure difference values (deltas) since the last full measured pressure data. Since the data of table 1 shows both full sets of data and changes to that data, table 1 may be referred to as a difference data table.

TABLE 1

| Difference Data | | |
|---|---|---|
| Sample # | Annular pressure (16 bits per sample) | Deltas to the previous full data (i.e., #1 or #10) |
| 1 | 2590 | N/A |
| Send full data | | |
| 2 | 2590 | 0 |
| 3 | 2590 | 0 |
| 4 | 2591 | 1 |
| 5 | 2590 | 0 |
| 6 | 2593 | 3 |
| 7 | 2590 | 0 |
| 8 | 2591 | 1 |
| 9 | 2591 | 1 |
| 10 | 2589 | −1 |
| 11 | 2590 | 0 |
| Send full data | | |
| 12 | 2592 | 2 |
| 13 | 2591 | 1 |
| 14 | 2590 | 0 |
| 15 | 2591 | 1 |
| 16 | 2591 | 1 |
| 17 | 2589 | −1 |
| 18 | 2594 | 4 |
| 19 | 2589 | −1 |

TABLE 1-continued

| Difference Data | | |
|---|---|---|
| Sample # | Annular pressure (16 bits per sample) | Deltas to the previous full data (i.e., #1 or #10) |
| 20 | 2591 | 1 |
| 21 | 2589 | −1 |
| Send full data | | |

In operation, a wellbore tool may collect sensor data and send a measured value that corresponds to that sensed data to the surface. This first measured value may be sent using 16 bits of data that indicates that the downhole pressure is 2590 pounds per square inch (psi). Since this is a first measurement sent up the wellbore, it may be sent without any difference data. In certain instances, pressure data may be sent periodically. For example, pressure data may be sent every 10 minutes. When the wellbore tool prepares to send another value of pressure to the surface, it may compare a last sent measured pressure value to the current measured pressure value to identify a pressure change or difference. Once this pressure change/difference is identified, that difference may be sent to the surface. Table 1 identifies that each of samples 2 through 10 have a respective pressure value and a difference or delta pressure value relative to a previous sent measured value. The initial value sent to the surface was 2590 psi and respective difference values (changes in pressure) for samples 2 through 10 in table 1 are 0, 0, 1, 0, 3, 0, 1, 1, and −1.

The data of table 1 indicates that a second full 16-bit measured pressure value (sample 11) was sent to the surface. Table 1 also indicates that the second full pressure value may be sent to the surface with a difference value. In an instance when data of sample 1 is corrupted in transmission, data from sample 2 may be used to identify the pressure associated with sample 1 and may be used to identify pressures associated with each of samples 2 through 10. Table 1 also shows that values of samples 12 through 14 may be determined using difference values and that sample 21 was sent as a 16-bit value.

In certain instances, a detection rate may be defined as a possibility of a data transmission unit being successfully transmitted from the downhole to the surface. In an instance when a detection rate for a given wellbore corresponds to a 90% rate, the probability of transmitting a particular data unit (e.g., a set of payload data) would be 90%.

As discussed above, a combination of full values of measurement data and difference values (deltas) to reduce the number of bits required to send telemetry data up a wellbore to the surface. As shown in table 1, when a full measurement data would be sent up-hole for samples #1, #11, and #21, when 16 bits are used to send these measurement values, and when difference values are sent for samples #2 through #10 and #12 through #20, each respective data value for samples #2 through #10 and #12 through #20 may be identified by summing a previous measurement value with a difference (delta) value. For samples #2 through #10, the difference values may be calculated with respect to sample #1; for samples #12 and #20, the difference values may be calculated with respect to sample #11. This process may be referred to as a referred to as full-and-delta compression-telemetry scheme without redundancy. In an instance when each sample occupies 16 bits and 4 bits are allocated for each difference value, the total size for samples #1 to #20 is (2*16)+(18*4)=104 bits. The compression ratio, defined as the uncompressed size divided by the compressed size, is 320/104=3.08. Given a 90% detection rate, the success probability of sample #1 is 90%. The success probability of transmitting sample #2 requires the successful transmission of both samples #1 and #2. Therefore, the success rate of sample #2 is 90%*90%=81%. The same formula applies to the calculation for the success rates of samples #3 to #10. The success rates of all samples are summarized in table 2, second column. One risk relates to the loss or corruption of sample #1 as the full data of samples #2 to #10 could not be recovered, without something more, even when the deltas are transmitted successfully. Furthermore, without something more, the possibility of losing any of continuous data samples #1 to #10 is about 10% (i.e., the possibility of losing sample #1).

When difference values are also sent with a second or subsequent full measurement data value, the probability of determining respective data measurement values increases. In an instance when a full measurement dataset includes 16 bits representing a measurement value and 4 bits of difference value and each subsequent difference (e.g., for samples #2 through #20), the total number of bits used to represent samples #1 through #20 are equal to 2*(16+4)+(18*4)=112 bits. Since these 112 bits represent 320 actual bits of data, a compression ratio associated with this technique is 320/112=2.86.

In an instance when sample #1 itself is lost in the transmission process and when sample #11 is successfully transmitted with a difference value, sample #1 can be recovered using the full data of sample #11 and the difference value between sample #11 and sample #1. An adjusted probability of successfully transmitting sample #1 raises to 90%+(0.10*90%)=99% and the probability of successfully transmitting the difference values (e.g., of samples #2 through #10) raises to (99%*0.90%)=89.1%. The modified process that includes transmitting difference values with full measurement values may be referred to as full-and-delta compression-telemetry scheme with redundancy.

TABLE 2

Full-and-Delta Compression-Telemetry Scheme with Redundancy

| Sample # | Success rate: full-and-delta compression-telemetry scheme without redundancy | Success rate: full-and-delta compression-telemetry scheme with redundancy |
|---|---|---|
| . . . | . . . | . . . |
| 1 | 90% | 99% |
| 2 | 81% | 89.10% |
| 3 | 81% | 89.10% |
| 4 | 81% | 89.10% |
| 5 | 81% | 89.10% |
| 6 | 81% | 89.10% |
| 7 | 81% | 89.10% |
| 8 | 81% | 89.10% |
| 9 | 81% | 89.10% |
| 10 | 81% | 89.10% |
| 11 | 90% | 99% |
| 12 | 81% | 89.10% |
| 13 | 81% | 89.10% |
| 14 | 81% | 89.10% |
| 15 | 81% | 89.10% |
| 16 | 81% | 89.10% |
| 17 | 81% | 89.10% |
| 18 | 81% | 89.10% |
| 19 | 81% | 89.10% |
| 20 | 81% | 89.10% |

TABLE 2-continued

Full-and-Delta Compression-Telemetry Scheme with Redundancy

| Sample # | Success rate: full-and-delta compression-telemetry scheme without redundancy | Success rate: full-and-delta compression-telemetry scheme with redundancy |
|---|---|---|
| 21 | 90% | 99% |

While the data of table 1 illustrates pressure, this technique may be used to send indications of updated values of one or more other types of measurements to a computer at the surface of a wellbore. For example, in an instance when data sent to the surface includes borehole pressure, annular pressure, weight-on-bit, torque-on-bit, and temperature, each of the respective values or difference may be sent using a different transmission or one or more of the respective values may be sent in a combined transmission.

In certain instances, a transmission sent to the surface may include a field of zeros, a synchronization byte, payload data, and an error check value (e.g., a cyclic redundancy check (CRC) value. The field of zeros may be represented as a continuous frequency signal used to synchronize timing of a phase locked loop (PLL). The sync byte may have a pattern that allows decoding circuits to identify when to decode the identifier. An identifier in the payload data may allow the decoding circuits to properly parse the remaining portion of the payload data. When a CRC value is used, the decoding circuits evaluate whether the payload data was received without error. In an example, a sync byte may consist of bits with values 1010 and identifiers could be assigned values of any of 1010, 1011, and 1101. A convention associated with each of the identifiers may indicate a total number of bits in the payload data and may indicate how the payload data is partitioned.

The data of table 3 illustrates how identifiers may be used to show how payload data is partitioned in a particular transmission. Identifiers in table 3 include 0101, 0110, 0111, 1000, 1000, 1001, and 1100. In such an instance, the synchronization byte may have a value of 1010. As soon as synchronization byte 1010 is decoded, an identifier could be extracted from a set of received data. According to the data of table 3, an identifier of 0101 indicates that the payload data may identify a full 16 bits of borehole pressure data, 4 bits of delta borehole pressure difference data, and 4 bits of annular pressure delta data. In an instance when the identifier is expressed using 4 bits, the payload data would include 28 bits. As mentioned above, a transmission could include a field of zeros, a synchronization byte, payload data, and an error check value. The term N/A in table 3 indicates that the particular value is not included in (is not applicable to) the particular identifier.

Depending on a particular implementation, the total number of bits used in a transmission may be limited to a selected maximum number of bits. How data is combined in a particular transmission may correspond to a convention or a set of rules associated with transmitting data through a fluid medium using a mud pulse telemetry technique of the present disclosure. In certain instances, techniques of the present disclosure may transmit data via electromagnetic data transmissions. This may include transmitting data via wirelessly.

TABLE 3

Data Content Identifier Cross-Reference

| Identifier | Full and/or Delta Borehole Pressure | Full and/or Delta Annular Pressure | Full and/or Delta Weight on Bit | Full and/or Delta Drill Bit Torque | Full and/or Delta Temperature |
|---|---|---|---|---|---|
| 0101 | Full 16 bits + Delta 4 bits | Delta 4 bits | N/A | N/A | N/A |
| 0110 | Delta 4 bits | Full 16 bits + Delta 4 bits | N/A | N/A | N/A |
| 0111 | N/A | N/A | Full 16 bits + 4 bits | Delta 4 bits | N/A |
| 1000 | Delta 4 bits | Delta 4 bits | Delta 4 bits | Delta 4 bits | Delta 4 bits |
| 1001 | N/A | N/A | Delta 4 bits | Full 16 bits + Delta 4 bits | N/A |
| 1100 | N/A | N/A | N/A | N/A | Full 16 bits + Delta 4 bits |

Figure 2:
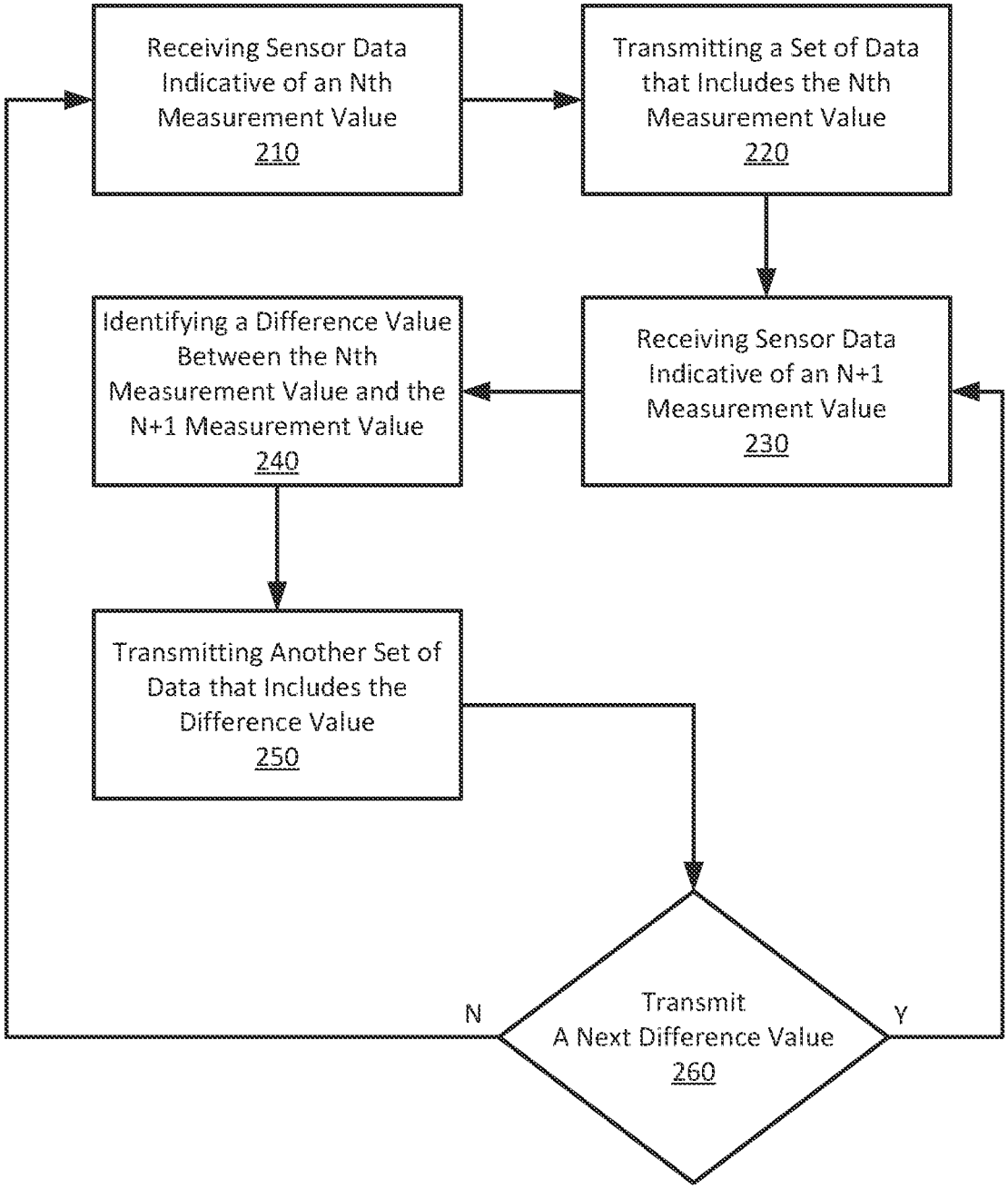
FIG. 2 illustrates actions that may be performed when data is received and transmitted, in accordance with various aspects of the subject technology.

FIG. 2 illustrates actions that may be performed when data is received and transmitted. At block 210 sensor data may be received at a wellbore tool. In an instance when transmissions of sensor data have just begun, a first set of data may be transmitted at block 220 that includes a first measurement value. This first measurement value may be included in a first dataset that is transmitted via a fluid medium to a computing device. The fluid medium that the first dataset is transmitted through may include drilling mud into which the wellbore tool is immersed. As such, the wellbore tool may be configured to transmit data from beneath the surface of the Earth to a computer that is located at the surface of the Earth. As mentioned above, this first measurement value may identify a pressure, or some other value sensed by a sensor deployed with the wellbore tool. In instances when the wellbore tool previously transmitted other measurement values, the transmitted measurement value may be associated with an Nth measurement value. In certain instances, the measurement value transmitted at block 220 may also be transmitted with a difference value that may be used to perform a data recovery function.

At block 230 additional sensor data may be received. This additional sensor data may be indicative of a second or N+1 measurement value. At block 240 a difference value may be identified that corresponds to a difference between the first and the second measurement value (or a difference between an Nth and an N+1 measurement value). The difference value identified at block 240 may then be transmitted at block 250 in a second or another set of data.

Determination block 260 may then identify whether a next difference value should be transmitted, when yes, additional sensor data may be received at block 230 such that yet another difference value can be identified at block 240 and then this other difference value can be transmitted at block 250. When determination block 260 identifies that a next difference value should not be transmitted, program flow may move back to block 210 where another sensor measurement value is identified at block 210 such that this other sensor measurement value can be transmitted at block 220.

The actions performed in FIG. 2 may implement the transmission sequence discussed in respect to table 1 above where a full measurement data value was sent in a first transmission, followed by nine different transmissions of difference values. Here again this process may repeat with another full measurement value being transmitted followed by another nine different transmissions of difference values.

The actions discussed in respect to FIG. 2 may be expressed in terms of sample numbers #N, #N+1, #N+2 . . . 2N, 2N+1, and so on. From this perspective, techniques of the present disclosure may include actions:

1. Acquiring a series of data samples down a wellbore;
2. Selecting an interval N, where the interval N identifies samples for which full sets of measurement data value will be sent up the wellbore, where interval N may be any value;
3. Sending a full measurement data value and a difference (delta) value for samples #1, #(N+1), #(2N+1) . . . up the wellbore over time. The difference value may be computed by identifying the difference between a current full measurement value and a previous full measurement data value. For example, for sample #(2N+1), the corresponding difference value is computed as sample #(2N+1) minus the full measurement value of sample #(N+1);
4. Sending respective difference values for samples #2 to #N, #(N+2) to #(2N), #(2N+2) to #(3N) . . . up the wellbore between respective full measurement data values. These difference values may be computed by identifying difference between a current sensed value and a previous full measurement value. For example, for sample #(N+5), the corresponding difference value may be computed as a current sensed value of sample #(N+5) minus the full measurement data value #(N+1).

In other instances, actions expressed in terms of sample numbers #N, #N+1, #N+2 . . . 2N, 2N+1, and so on may include:

1. Acquiring a series of data samples down a wellbore;
2. Selecting an interval N, where the interval N identifies samples for which full sets of measurement data value will be sent up the wellbore, where interval N may be any value;

3A: Sending a full measurement data value and a difference (delta) value for samples #1, #(N+1), #(2N+1) . . . up the wellbore over time. The difference value may be computed as the difference between a current sensed value and a previous full measurement value. For example, for sample #(2N+1), the corresponding difference value is computed as the full measurement value #(2N+1) minus a sensed value of sample #(2N).

4A: Sending respective difference values for samples #2 to #N, #(N+2) to #(2N), #(2N+2) to #(3N) . . . up the wellbore between respective full measurement values. The delta is computed as the difference between the current sensed value and the previous sensed value. For example, for sample #(N+5), the corresponding delta is computed as the sensed value of sample #(N+5) minus the sensed value of sample #(N+4).

Figure 3:
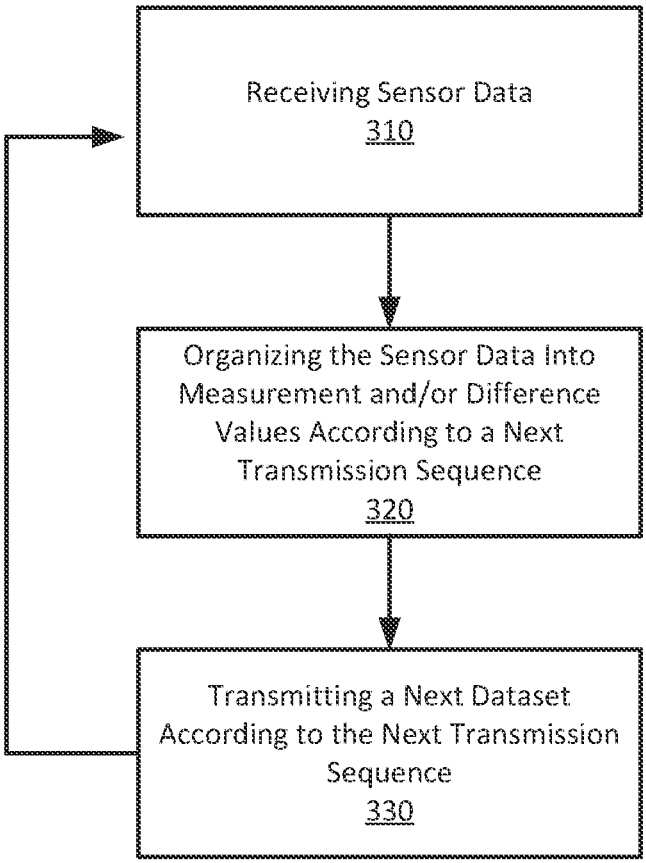
FIG. 3 illustrates a series of actions that may be performed when sensor data is received, organized, and transmitted, in accordance with various aspects of the subject technology.

FIG. 3 illustrates a series of actions that may be performed when sensor data is received, organized, and transmitted. At block 310 sensor data may be received. This may include receiving data from one or more sensors. At block 320 the data may be organized into a dataset that includes payload data and an identifier. Here again the identifier may identify how data in the payload data of a particular transmission is partitioned. This payload data may include one or more measurement values, one or more difference values, or a combination of both. The dataset may then be transmitted at block 330. This process may repeat for as long as a wellbore tool operates.

Figure 4:
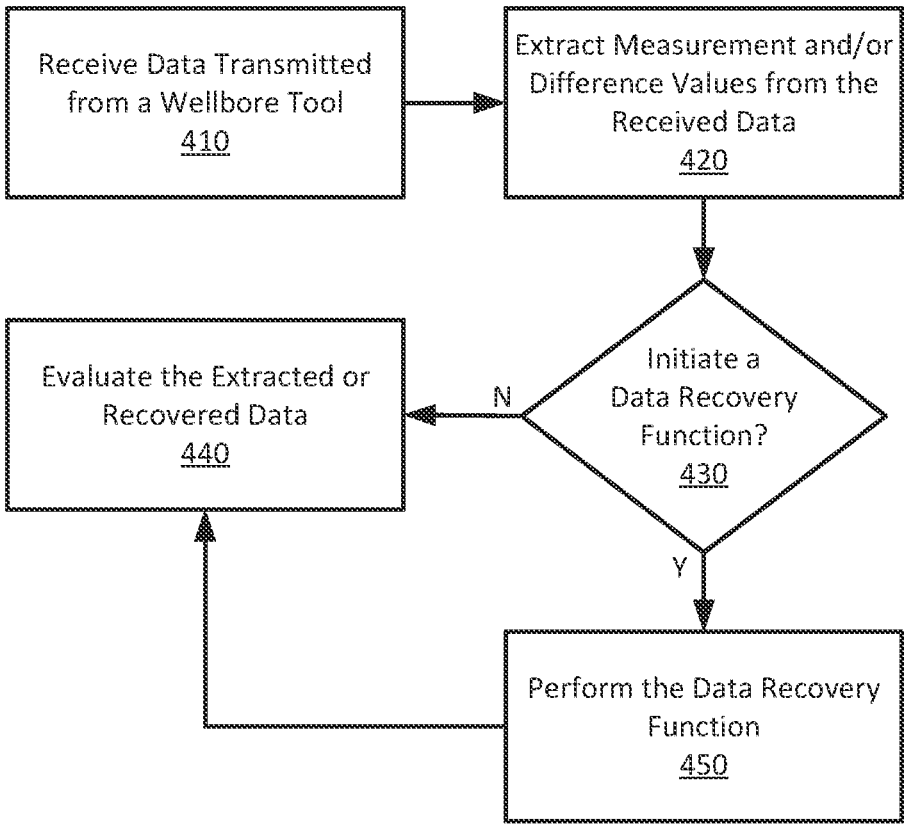
FIG. 4 illustrates actions that may be performed by a computing device that receives data transmissions from tools deployed in a wellbore, in accordance with various aspects of the subject technology.

FIG. 4 illustrates actions that may be performed by a computing device that receives data transmissions from tools deployed in a wellbore. At block 410, data transmitted from a wellbore tool may be received. Measurement values and/or difference values may be extracted from the transmitted data at block 420. The received data may be extracted using a set of electronics that may include a phase locked loop that synchronizes data separation circuitry. A synchronization byte at the beginning data included in the transmission may be used to identify where a set of payload data included in the transmission begins. When used, an identifier discussed in respect to table 2 may be extracted from the data and individual pieces of data may be extracted based on the identifier. Determination block 430 may identify whether a data recovery function should be initiated. This may include identifying whether a previously sent measurement value of pressure value of sample 1 or 11 of table 1 was properly received. Such a determination may be made based on whether an error check value (e.g., a CRC value) associated with the previously sent measurement data matches an error check value sent with the previous measurement data. When determination block 430 identifies that the data recovery function should not be initiated, program flow may move to block 440 where data extracted at block 420 is evaluated. Such an evaluation may identify any type of sensor measurement values associated with the data received at block 410. When the received data includes one or more measurement values, those measurement values may be recorded. When the received data includes difference values, respective difference values may be used to identify current measurement values by adding the different the respective different values to previously sent measurement values. When determination block 430 identifies that the data recovery function should be initiated, that data recovery function may be implemented at block 450. Recovering a previously corrupted measurement value may be performed by extracting a current measurement value and a difference value from the data received at block 410 and then adding this difference value to the current measurement value. This may include identifying the full measurement value and different value of sample #11 and adding the full these two values together to identify (or verify) the full measurement value of sample #1.

A computer that resides at the surface of a wellbore may also transmit data to circuits or devices that are located at a tool deployed in the wellbore. For example, this computer may identify a current depth of a wellbore tool and may send a depth value to circuits located at the wellbore tool. At a later time, the computer may identify a second depth value and subtract the second depth value from the first depth value to identify a depth difference value that can be sent to the circuits of the wellbore tool. After these circuits receive both the first depth value and the depth difference value, those circuits may identify the second depth value by performing a calculation. This may include adding the depth difference value to the first depth value. Other values that may be sent to the wellbore tool include surface pressure values, values associated with nearby wells, or values that adjust a wellbore operation (e.g., the direction of a wellbore trajectory).

Figure 5:
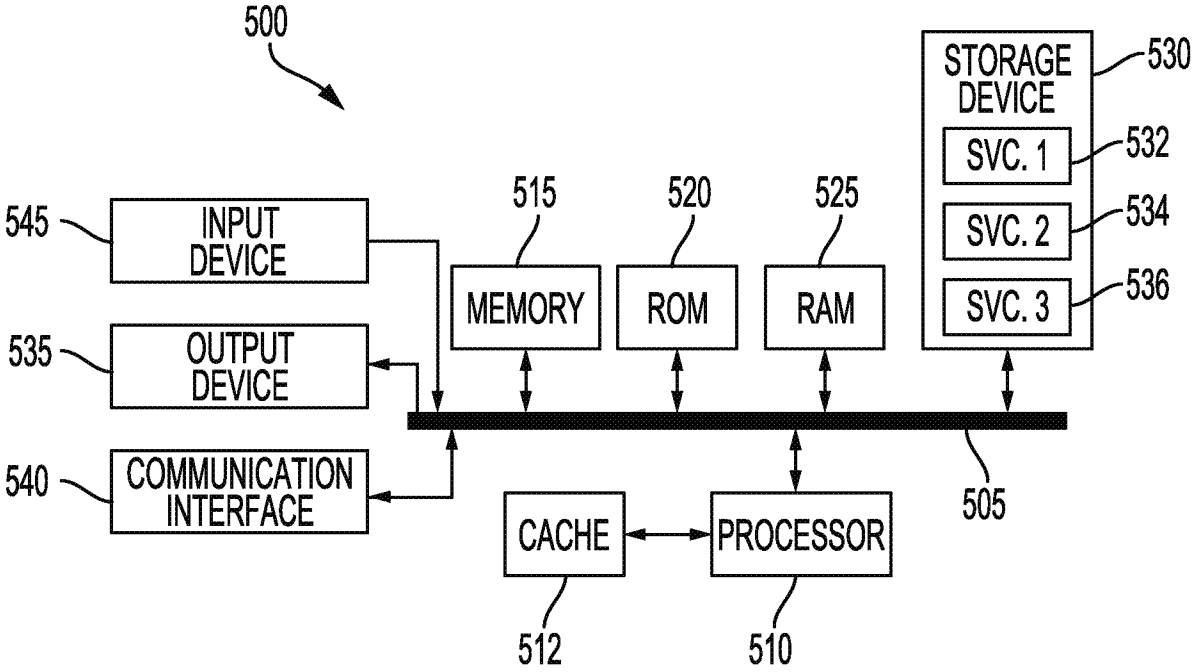
FIG. 5 illustrates an example computing device architecture which can be employed to perform any of the systems and techniques described herein.

FIG. 5 illustrates an example computing device architecture which can be employed to perform any of the systems and techniques described herein. In some examples, the computing device 500 architecture can be integrated with tools described herein. The components of the computing device architecture 500 are shown in electrical communication with each other using a connection 505, such as a bus. The example computing device architecture 500 includes a processing unit (CPU or processor) 510 and a computing device connection 505 that couples various computing device components including the computing device memory 515, such as read only memory (ROM) 520 and random access memory (RAM) 525, to the processor 510.

The computing device architecture 500 can include a cache of high-speed memory connected directly with, in close proximity to, or integrated as part of the processor 510. The computing device architecture 500 can copy data from the memory 515 and/or the storage device 530 to the cache 512 for quick access by the processor 510. In this way, the cache can provide a performance boost that avoids processor 510 delays while waiting for data. These and other modules can control or be configured to control the processor 510 to perform various actions. Other computing device memory 515 may be available for use as well. The memory 515 can include multiple different types of memory with different performance characteristics. The processor 510 can include any general-purpose processor and a hardware or software service, such as service 1 532, service 2 534, and service 3 536 stored in storage device 530, configured to control the processor 510 as well as a special-purpose processor where software instructions are incorporated into the processor design. The processor 510 may be a self-contained system, containing multiple cores or processors, a bus, memory controller, cache, etc. A multi-core processor may be symmetric or asymmetric.

To enable user interaction with the computing device architecture 500, an input device 545 can represent any number of input mechanisms, such as a microphone for speech, a touch-sensitive screen for gesture or graphical input, keyboard, mouse, motion input, speech and so forth. An output device 535 can also be one or more of a number of output mechanisms known to those of skill in the art, such as a display, projector, television, speaker device, etc. In some instances, multimodal computing devices can enable a user to provide multiple types of input to communicate with the computing device architecture 500. The communications interface 540 can generally govern and manage the user input and computing device output. There is no restriction on operating on any particular hardware arrangement and therefore the basic features here may easily be substituted for improved hardware or firmware arrangements as they are developed.

Storage device 530 is a non-volatile memory and can be a hard disk or other types of computer readable media which can store data that are accessible by a computer, such as magnetic cassettes, flash memory cards, solid state memory devices, digital versatile disks, cartridges, random access memories (RAMs) 525, read only memory (ROM) 520, and hybrids thereof. The storage device 530 can include services 532, 534, 536 for controlling the processor 510. Other hardware or software modules are contemplated. The storage device 530 can be connected to the computing device connection 505. In one aspect, a hardware module that performs a particular function can include the software component stored in a computer-readable medium in connection with the necessary hardware components, such as the processor 510, connection 505, output device 535, and so forth, to carry out the function.

For clarity of explanation, in some instances the present technology may be presented as including individual functional blocks including functional blocks comprising devices, device components, steps or routines in a method implemented in software, or combinations of hardware and software.

In some instances, the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can include, for example, instructions and data which cause or otherwise configure a general purpose computer, special purpose computer, or a processing device to perform a certain function or group of functions. Portions of computer resources used can be accessible over a network. The computer executable instructions may be, for example, binaries, intermediate format instructions such as assembly language, firmware, source code, etc. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can include hardware, firmware and/or software, and can take any of a variety of form factors. Typical examples of such form factors include laptops, smart phones, small form factor personal computers, personal digital assistants, rackmount devices, standalone devices, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are example means for providing the functions described in the disclosure.

In the foregoing description, aspects of the application are described with reference to specific examples and aspects thereof, but those skilled in the art will recognize that the application is not limited thereto. Thus, while illustrative examples and aspects of the application have been described in detail herein, it is to be understood that the disclosed concepts may be otherwise variously embodied and employed, and that the appended claims are intended to be construed to include such variations, except as limited by the prior art. Various features and aspects of the above-described subject matter may be used individually or jointly. Further, examples and aspects of the systems and techniques described herein can be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate examples, the methods may be performed in a different order than that described.

Where components are described as being "configured to" perform certain operations, such configuration can be accomplished, for example, by designing electronic circuits or other hardware to perform the operation, by programming programmable electronic circuits (e.g., microprocessors, or other suitable electronic circuits) to perform the operation, or any combination thereof.

The various illustrative logical blocks, modules, circuits, and algorithm steps described in connection with the examples disclosed herein may be implemented as electronic hardware, computer software, firmware, or combinations thereof. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present application.

The techniques described herein may also be implemented in electronic hardware, computer software, firmware, or any combination thereof. Such techniques may be implemented in any of a variety of devices such as general purposes computers, wireless communication device handsets, or integrated circuit devices having multiple uses including application in wireless communication device handsets and other devices. Any features described as modules or components may be implemented together in an integrated logic device or separately as discrete but interoperable logic devices. If implemented in software, the techniques may be realized at least in part by a computer-readable data storage medium comprising program code including instructions that, when executed, performs one or more of the method, algorithms, and/or operations described above. The computer-readable data storage medium may form part of a computer program product, which may include packaging materials.

The computer-readable medium may include memory or data storage media, such as random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates program code in the form of instructions or data structures and that can be accessed, read, and/or executed by a computer, such as propagated signals or waves.

Methods and apparatus of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Such methods may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

In the above description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it may be deviated or horizontal. Correspondingly, the transverse, axial, lateral, longitudinal, radial, etc., orientations shall mean orientations relative to the orientation of the wellbore or tool.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or another word that substantially modifies, such that the component need not be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Claim language or other language in the disclosure reciting "at least one of" a set and/or "one or more" of a set indicates that one member of the set or multiple members of the set (in any combination) satisfy the claim. For example, claim language reciting "at least one of A and B" or "at least one of A or B" means A, B, or A and B. In another example, claim language reciting "at least one of A, B, and C" or "at least one of A, B, or C" means A, B, C, or A and B, or A and C, or B and C, or A and B and C. The language "at least one of" a set and/or "one or more" of a set does not limit the set to the items listed in the set. For example, claim language reciting "at least one of A and B" or "at least one of A or B" can mean A, B, or A and B, and can additionally include items not listed in the set of A and B.

Illustrative Aspects of the disclosure include:

Aspect 1: A method comprising receiving sensor data indicative of a first measurement value at a tool deployed in a wellbore; transmitting a first set of data that includes the first measurement value; receiving sensor data indicative of a second measurement value at the tool deployed in the wellbore; calculating a first difference value by subtracting the second measurement value from the first measurement value; and transmitting a second set of data that includes the first difference value.

Aspect 2: The method of Aspect 1, wherein the first set of data and the second set of data are transmitted via a fluid medium or as an electromagnetic transmission.

Aspect 3: The method of any of Aspects 1 or 2, further comprising receiving the first set of data that includes the first measurement value; receiving the second set of data that includes the first difference value; identifying the second measurement value by adding the first measurement value to the first difference value; receiving a third set of data that includes a second difference value; and identifying a third measurement value by performing a mathematical function based on the second difference value.

Aspect 4: The method of any of Aspects 1 through 3, wherein a/the mathematical function includes adding the second difference value to the first measurement value.

Aspect 5: The method of any of Aspects 1 through 4, wherein a/the mathematical function includes adding the first difference value to a/the second difference value.

Aspect 6: The method of any of Aspects 1 through 5, further comprising organizing a first set of information to send to circuits at the tool deployed in the wellbore from an electronic device located up the wellbore from the tool, the first set of information including a first well related value associated with operation of the wellbore; transmitting the first set of information to the tool from the electronic device; identifying a second well value associated with operation of the wellbore; calculating a well related difference value by subtracting the second well value from the first well value; and transmitting a second set of information to the circuits at the tool that includes the well related difference value to the circuits from the electronic device, wherein the circuits identify the second well value based on receipt of the first well value and the well related difference value.

Aspect 7: The method of any of Aspects 1 through 6, further comprising receiving sensor data indicative of a third measurement value; and transmitting a third set of data that includes a/the third measurement value and a second difference value, wherein the second measurement value is identified by subtracting the second difference value from the third measurement value.

Aspect 8: A system comprising: one or more sensors deployed at a wellbore; and a first set of electronic components communicatively coupled to the one or more sensors deployed at the wellbore, wherein the first set of electronic components: receive sensor data indicative of a first measurement value at a tool deployed in a wellbore, transmit a first set of data that includes the first measurement value, receive sensor data indicative of a second measurement value at the tool deployed in the wellbore, calculate a first difference value by subtracting the second measurement value from the first measurement value, and transmit a second set of data that includes the first difference value.

Aspect 9: The system of Aspect 8, wherein the first set of data and the second set of data are transmitted via a fluid medium or as an electromagnetic transmission.

Aspect 10: The system of any of Aspects 8 or 9, further comprising a second set of electronic components deployed up the wellbore from the one or more sensors, wherein the second set of electronic components: receive the first set of data that includes the first measurement value, receive the second set of data that includes the first difference value, identify the second measurement value by adding the first measurement value to the first difference value, receive a third set of data that includes a second difference value, and identify a third measurement value by performing a mathematical function based on the second difference value.

Aspect 11: The system of any of Aspects 8 through 10, wherein a/the mathematical function includes adding the second difference value to the first measurement value.

Aspect 12: system of any of Aspects 8 through 11, wherein a/the mathematical function includes adding the first difference value to a/the second difference value.

Aspect 13: The system of any of Aspects 8 through 10, wherein data is transmitted from an electronic device located at an upper portion of the wellbore to the tool deployed in the wellbore.

Aspect 14: The system of any of Aspects 8 through 14, wherein the first set of electronic components receive sensor data indicative of a third measurement value and transmit a third set of data that includes the third measurement value and a/the second difference value; and wherein the second measurement value is identified by subtracting the second difference value from the third measurement value.

Aspect 15: A non-transitory computer-readable storage medium having embodied thereon instructions executable by one or more processors to receive sensor data indicative of a first measurement value at a tool deployed in a wellbore, transmit a first set of data that includes the first measurement value, receive sensor data indicative of a second measurement value at the tool deployed in the wellbore, calculate a first difference value by subtracting the second measurement value from the first measurement value, and transmit a second set of data that includes the first difference value.

Aspect 16: The non-transitory computer-readable storage medium of Aspect 15, wherein first set of data and the second set of data are transmitted via a fluid medium or as an electromagnetic transmission.

Aspect 17: The non-transitory computer-readable storage medium of any of Aspects 15 or 16, wherein a receiving device: receives the first set of data that includes the first measurement value, receives the second set of data that includes the first difference value, identifies the second measurement value by adding the first measurement value to the first difference value, receives a third set of data that includes a second difference value, and identifies a third measurement value by performing a mathematical function based on the second difference value.

Aspect 18: The non-transitory computer-readable storage medium of any of Aspects 15 through 17, wherein a/the mathematical function includes adding a/the second difference value to the first measurement value.

Aspect 19: The non-transitory computer-readable storage medium of any of Aspects 15 through 18, wherein the mathematical function includes adding the first difference value to a/the second difference value.

Aspect 20: The non-transitory computer-readable storage medium of any of Aspects 15 through 19, wherein a/the first set of data is identified as being corrupted at the receiving device, the second set of data includes the second measurement value, and the first measurement value is identified by subtracting the first difference value from the second measurement value.

What is claimed is:

1. A method comprising:

receiving first sensor data indicative of a first measurement value at a tool deployed in a wellbore;

transmitting a first set of data that includes the first measurement value;

receiving second sensor data indicative of a second measurement value at the tool deployed in the wellbore;

calculating a first difference value by subtracting the second measurement value from the first measurement value;

transmitting a second set of the data that includes the first difference value and the second measurement value;

identifying the first measurement value based on the first difference value and the second measurement value that are transmitted together in the second set of the data to supplement the first measurement value transmitted in the first set of the data if the first set of the data is lost during transmission.

2. The method of claim 1, wherein the first set of the data and the second set of the data are transmitted via a fluid medium or as an electromagnetic transmission.

3. The method of claim 1, further comprising:

receiving third sensor data that includes a third measurement value that occurs in time between the first measurement value and the second measurement value;

transmitting a third set of the data that comprises a second difference value associated with the third measurement value; and identifying the third measurement value by performing a mathematical function based on the second difference value.

4. The method of claim 3, wherein the mathematical function includes adding the second difference value to the first measurement value.

5. The method of claim 3, wherein the mathematical function includes adding the first difference value to the second measurement value.

6. The method of claim 3, further comprising refraining from including the third measurement value in the third set of the data that is transmitted.

7. The method of claim 1, further comprising:

organizing a first set of information to send to circuits at the tool deployed in the wellbore from an electronic device located up the wellbore from the tool, the first set of the information including a first well value associated with operation of the wellbore;

transmitting the first set of the information to the tool from the electronic device;

identifying a second well value associated with the operation of the wellbore;

calculating a well related difference value by subtracting the second well value from the first well value; and transmitting a second set of the information to the circuits at the tool from the electronic device, the second set of the information comprising the well related difference value and the second well value, wherein the circuits identify the first well value based on the well related difference value and the second well value.

8. The method of claim 1, further comprising:

receiving third sensor data indicative of a third measurement value that occurs in time between the first measurement value and the second measurement value; and transmitting, to circuits at the tool from an electronic device, a third set of the data that includes the third measurement value and a second difference value associated with the third measurement value, wherein the third measurement value is identified by performing a mathematical function based on the second difference value.

9. A system comprising:

one or more sensors deployed at a wellbore; and a first set of electronic components communicatively coupled to the one or more sensors deployed at the wellbore, wherein the first set of the electronic components:

receive first sensor data indicative of a first measurement value at a tool deployed in the wellbore, transmit a first set of data that includes the first measurement value, receive second sensor data indicative of a second measurement value at the tool deployed in the wellbore, calculate a first difference value by subtracting the second measurement value from the first measurement value, transmit a second set of the data that includes the first difference value and the second measurement value, and a second set of the electronic components deployed up the wellbore from the one or more sensors, wherein the second set of the electronic components identify the first measurement value based on the first difference value and the second measurement value that are transmitted together in the second set of the data to supplement the first measurement value transmitted in the first set of the data if the first set of the data is lost during transmission.

10. The system of claim 9, wherein the first set of the data and the second set of the data are transmitted via a fluid medium or as an electromagnetic transmission.

11. The system of claim 9, wherein the first set of the electronic components are configured to:

receive third sensor data that includes a third measurement value that occurs in time between the first measurement value and the second measurement value, transmit a third set of the data that comprises a second difference value associated with the third measurement value, and wherein the second set of the electronic components are configured to:

identify the third measurement value by performing a mathematical function based on the second difference value.

12. The system of claim 11, wherein the mathematical function includes adding the second difference value to the first measurement value.

13. The system of claim 11, wherein the mathematical function includes adding the first difference value to the second difference value.

14. The system of claim 11, wherein the data is transmitted from an electronic device located at an upper portion of the wellbore to the tool deployed in the wellbore.

15. The system of claim 9, wherein the first set of the electronic components are configured to:

receive third sensor data indicative of a third measurement value that occurs in time between the first measurement value and the second measurement value, and transmit a third set of the data that includes the third measurement value and a second difference value, and wherein the second measurement value is identified by subtracting the second difference value from the third measurement value.

16. A non-transitory computer-readable storage medium having embodied thereon instructions executable by one or more processors to:

receive first sensor data indicative of a first measurement value at a tool deployed in a wellbore, transmit a first set of data that includes the first measurement value, receive second sensor data indicative of a second measurement value at the tool deployed in the wellbore, calculate a first difference value by subtracting the second measurement value from the first measurement value, transmit a second set of the data that includes the first difference value and the second measurement value, and identify the first measurement value based on the first difference value and the second measurement value that are transmitted together in the second set of the data to supplement the first measurement value transmitted in the first set of the data if the first set of the data is lost during transmission.

17. The non-transitory computer-readable storage medium of claim 16, wherein the first set of the data and the second set of the data are transmitted via a fluid medium or as an electromagnetic transmission.

18. The non-transitory computer-readable storage medium of claim 16, wherein the instructions are further executable by the one or more processors to:

receive third sensor data that includes a third measurement value that occurs in time between the first measurement value and the second measurement value, transmit a third set of the data that comprises a second difference value associated with the third measurement value, and identify the third measurement value by performing a mathematical function based on the second difference value.

19. The non-transitory computer-readable storage medium of claim 18, wherein the mathematical function includes adding the second difference value to the first measurement value.

20. The non-transitory computer-readable storage medium of claim 18, wherein the mathematical function includes adding the first difference value to the second difference value.

21. The non-transitory computer-readable storage medium of claim 18, wherein the first set of the data is identified as being corrupted at a receiving device, the second set of the data includes the second measurement value, and the first measurement value is identified by subtracting the first difference value from the second measurement value.

* * * * *